US005398436A

United States Patent [19]

Suzuki

[11] Patent Number: 5,398,436

[45] Date of Patent: Mar. 21, 1995

[54] VISUAL PANEL

[75] Inventor: Teruo Suzuki, Chiba, Japan

[73] Assignee: SCS Promotion Company Limited, Chiba, Japan

[21] Appl. No.: 39,070

[22] PCT Filed: Oct. 1, 1992

[86] PCT No.: PCT/JP92/01269

§ 371 Date: Apr. 8, 1993

§ 102(e) Date: Apr. 8, 1993

[87] PCT Pub. No.: WO93/08554

PCT Pub. Date: Feb. 28, 1993

[30] Foreign Application Priority Data

Oct. 25, 1991 [JP] Japan ..... 3-306627

[51] Int. Cl.[6] ..... G09F 13/00; G09F 17/00

[52] U.S. Cl. ..... 40/558; 40/604; 38/102.9; 160/399

[58] Field of Search ..... 40/603, 604, 545, 558; 38/102.9; 160/399

[56] References Cited

U.S. PATENT DOCUMENTS

| | | | |
|---|---|---|---|
| 2,338,297 | 9/1944 | Mugdan et al. . | |
| 2,391,871 | 1/1946 | Benson . | |
| 2,527,258 | 10/1950 | Kahn . | |
| 2,647,261 | 8/1953 | Rassner . | |
| 2,928,198 | 3/1960 | Mandarick | 40/558 |
| 3,276,512 | 10/1966 | Gallagher . | |
| 3,461,584 | 8/1969 | Wilson . | |
| 3,701,210 | 10/1972 | Smith . | |
| 3,831,304 | 8/1974 | Miller et al. | 40/604 X |
| 3,995,715 | 12/1976 | Virtanen . | |
| 4,107,826 | 8/1978 | Tysdal | 160/399 X |
| 4,369,591 | 1/1983 | Vicino . | |
| 4,776,121 | 10/1988 | Vicino . | |
| 4,800,947 | 9/1989 | Loomis . | |
| 4,875,302 | 10/1989 | Noffsinger . | |
| 4,878,303 | 11/1989 | Banniza et al. | 40/603 X |
| 4,894,888 | 1/1990 | Bassouls . | |
| 4,976,057 | 12/1990 | Bianchi | 40/545 X |
| 5,020,254 | 6/1991 | Sheppard | 40/603 |
| 5,140,765 | 8/1992 | King | 40/603 |

FOREIGN PATENT DOCUMENTS

| | | |
|---|---|---|
| 8012/61 | 2/1964 | Australia . |
| 36221/68 | 3/1970 | Australia . |
| 88485/82 | 3/1983 | Australia . |
| 11165/88 | 8/1988 | Australia . |
| 12339/88 | 9/1988 | Australia . |
| 1041268 | 10/1978 | Canada . |
| 1219111 | 3/1987 | Canada . |
| 1294752 | 1/1992 | Canada . |
| 0078391 | 5/1983 | European Pat. Off. . |
| 0132495 | 2/1985 | European Pat. Off. . |
| 0136400 | 4/1985 | European Pat. Off. . |
| 0294301 | 12/1988 | European Pat. Off. . |
| 0296863 | 12/1988 | European Pat. Off. . |
| 0389104 | 3/1990 | European Pat. Off. . |
| 2255448 | 3/1974 | France . |
| 2572832 | 5/1986 | France . |
| 2624062 | 6/1989 | France . |
| 2217826 | 10/1973 | Germany . |
| 2407552 | 8/1975 | Germany . |
| 2817210 | 11/1978 | Germany . |
| 3142829A1 | 5/1983 | Germany . |
| 2336733 | 2/1985 | Germany . |
| 3412064A1 | 10/1985 | Germany . |
| 51-42783 | 10/1976 | Japan . |
| 55-29454 | 2/1980 | Japan . |
| 57-66936 | 4/1982 | Japan . |
| 61-21367 | 2/1986 | Japan . |
| 63-115171 | 7/1988 | Japan . |
| 64-38672 | 3/1989 | Japan . |
| 1-229109 | 9/1989 | Japan . |
| 2-87283 | 7/1990 | Japan . |
| 2-190890 | 7/1990 | Japan . |
| 1482687 | 8/1977 | United Kingdom . |
| 2226591A | 7/1990 | United Kingdom . |

*Primary Examiner*—Edward K. Look
*Assistant Examiner*—Hoang Nguyen
*Attorney, Agent, or Firm*—Nixon & Vanderhye

[57] ABSTRACT

One visual panel 1 is allotted to each of two lanes 3 in such a manner as to cover and conceal from a competitor a lifting device portion of an apparatus for automatically aligning and arranging bowling pins 4 at a distal end of the lane 3 in a bowling alley 2. The visual panels 1 are disposed in a series by being supported by columns 5 rotatably in the direction of A. Each visual panel 1 comprises a frame 6; a flexible sheet 11 having swollen portions 9 and 10 at opposite edge portions 7 and 8; sheet stretching device 12 for slidably accommodating the swollen portions 9 and 10 at the opposite edge portions 7 and 8; and tension adjusting device 13 for adjusting the tension applied to the sheet 11.

5 Claims, 11 Drawing Sheets

VISUAL PANEL

DESCRIPTION

1. Technical Field

The present invention relates to a visual panel such as a lane decoration panel in a bowling alley, a display panel for outdoor-wall and rooftop advertizement, and a display panel for advertizement in station precincts.

2. Background Art

In a bowling alley, for instance, a wall is used for a lifting device portion of an apparatus for automatically aligning and arranging bowling pins at a distal end of a lane so as to cover and conceal the lifting device portion from a competitor. Conventionally, the number of unknocked-down pins and the like are displayed on this wall by electric light.

Recently, the display of the number of unknocked-down pins and the like has come to be given on a table or the like on the competitor's side. Instead of the electric-light display of the number of unknocked-down pins and the like, a multiplicity of panels on which pictures, photographs or the like are printed have come to be installed on the walls for covering and concealing the lifting device portion, so as to create a unique, favorable atmosphere of the interior of the bowling alley from the viewpoint of vision.

In many cases, however, such panels on which pictures, photographs or the like are printed are periodically replaced with new panels on which different pictures, photographs or the like are printed, so as to renew the atmosphere of the interior of the bowling alley. Yet, since such panels have a size of approximately 3 m $\times$1 m or thereabouts, much expense is required in the replacement operation, particularly in transportation, so that such panels are not necessarily satisfactory.

Such a problem is not restricted to panels in bowling alleys, and also occurs in the case of panels for rooftop advertizement which are periodically replaced.

The present invention has been devised in view of the above-described aspects, and its object is to provide a visual panel which facilitates transportation thereof and is thereby capable of reducing the replacement cost.

DISCLOSURE OF INVENTION

In accordance with the present invention, the aforementioned object is attained by a visual panel comprising: a frame; a flexible sheet having swollen portions at opposing edge portions thereof, respectively; and sheet stretching means for slidably accommodating the swollen portions at the opposing edge portions of the sheet and for stretching the sheet over the frame.

As a preferred example of the stretching means in accordance with the present invention, the stretching means comprises a first stretching device for slidably accommodating the swollen portion at one edge portion of the sheet and a second stretching device for slidably accommodating the swollen portion at the other edge portion of the sheet, wherein the first stretching device and the second stretching device are each provided with a hole for accommodating the swollen portion at the edge portion of the sheet and a slit through which the edge portion of the sheet continuing to the swollen portion is inserted. Here, in one example, at least one of the first stretching device and the second stretching device is secured to the frame or is disposed movably with respect to the frame. The frame and the stretching means may be formed of any of wood, metal, synthetic resin, and the like, but may preferably be formed of a hard plastic or aluminum, most preferably aluminum, in view of the mechanical strength or the light-weight characteristic.

In accordance with another aspect of the present invention, the visual panel further comprises tension adjusting means for adjusting a tension applied to the sheet. In the visual panel having such tension adjusting means in the present invention, it suffices if the first stretching device is secured to the frame, and the second stretching device is disposed movably with respect to the frame, wherein the tension adjusting means is provided between the second stretching device and the frame. In another form, it suffices if the first stretching device and the second stretching device are disposed movably with respect to the frame, wherein the tension adjusting means is disposed between the first stretching device and the second stretching device.

This tension adjusting means may be comprised of any of a ratchet-type lashing belt, a turnbuckle, a rubber band-type lashing belt, or a cam buckle-type lashing belt which are provided with hooks at both ends.

The flexible sheet in the present invention may be a general sheet, such as a nylon sheet or a vinyl sheet obtained by extrusion molding, or a cloth or a nonwoven sheet formed of natural fibers or chemical fibers or a combination thereof. In a case where illumination is provided from the rear surface of the sheet, a back-lit type may preferably be used as the sheet. As the swollen portion of the sheet, it is possible to use one in which the edge portion of the sheet itself is made to swell by being integrally formed, or one which is obtained by tucking in the edge portion of the sheet itself. Furthermore, the swollen portion may be one in which the edge portion is turned up and sewn together, and a flexible rope is inserted into a loop formed therein. The cross-sectional configuration of this swollen portion may be a circular, triangular, quadrangular, or other polygonal shape. The flexible sheet may preferably be slightly stretchable, but if it is excessively stretchable, there are cases where the picture or the like formed by printing or the like is distorted.

In accordance with the visual panel of the present invention, a picture, a photograph or the like is printed in advance on the flexible sheet. This sheet is stretched over the frame by using the stretching means, and is mounted in, for instance, a bowling alley or the like. When it is desirous to change the atmosphere of the interior of the bowling alley, the sheet is removed from the frame, and a sheet with a new different picture, a photograph or the like printed thereon is stretched over the frame. At that time, if the new and old sheets are transported in a rolled-up state, the operation does not take up much space and is facilitated remarkably.

In accordance with the visual panel of the present invention, since the portion where a picture, a photograph or the like is printed is the flexible sheet and is arranged to be removable, replacement and transportation thereof are very easy. As a result, the operating efficiency is improved remarkably, and the replacement cost can be reduced.

Hereafter, a more detailed description of the present invention will be given on the basis of specific examples shown in the drawings. Hence, the above-described invention and other aspects of the invention will become more apparent. It should be noted that the present invention is not restricted to these specific examples.

BEST MODE FOR CARRYING OUT THE INVENTION

Figure 1:
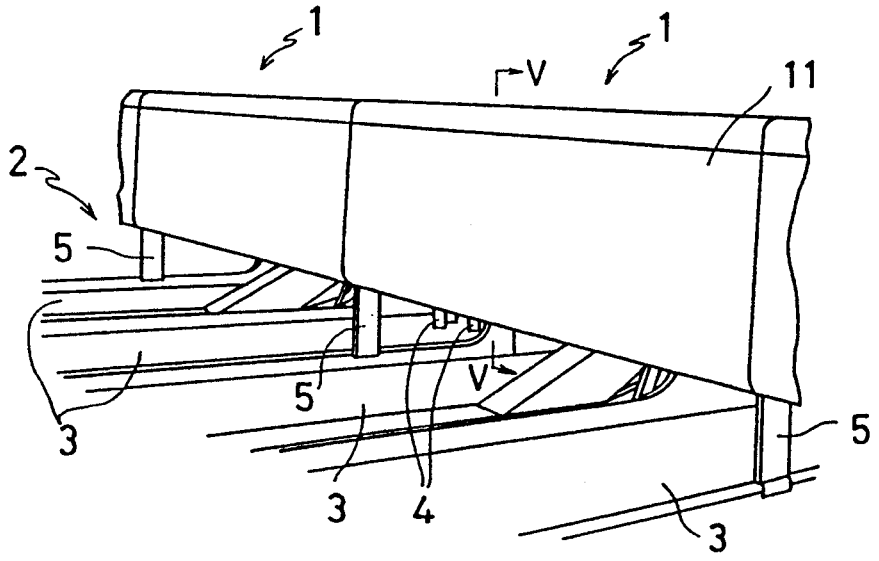
FIG. 1 is a perspective view of the interior of a bowling alley in which a preferred embodiment of the present invention is used.
Figure 2:
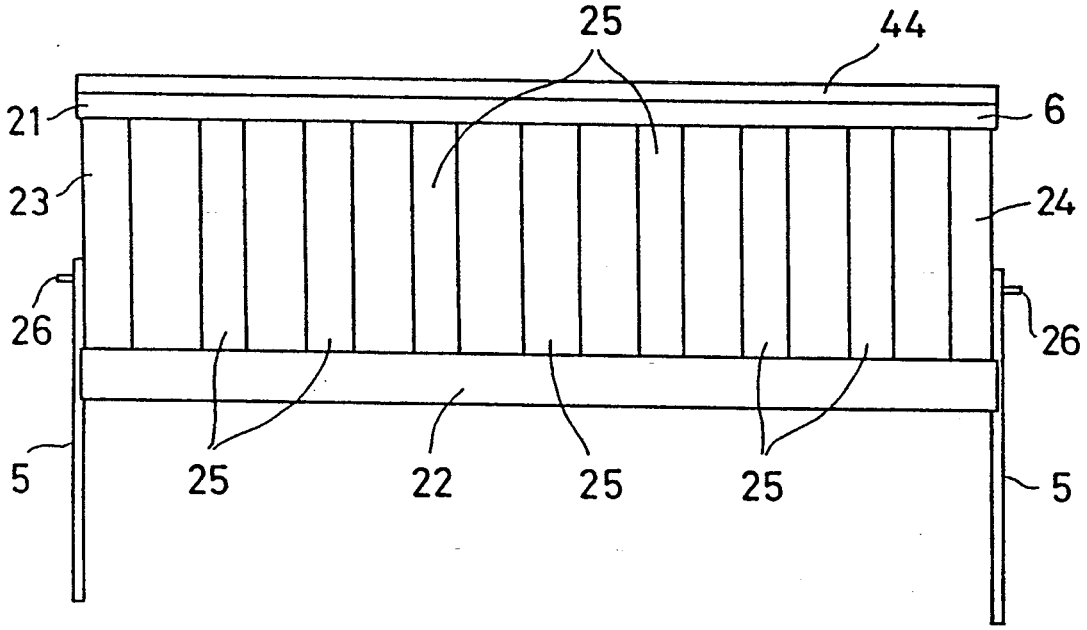
FIG. 2 is a front elevational view of a state in which a sheet is removed in the embodiment shown in FIG. 1.
Figure 3:
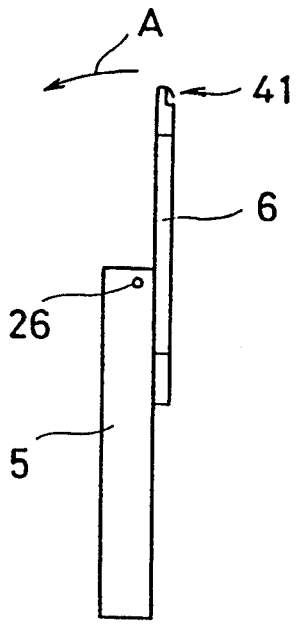
FIG. 3 is a left-hand side elevational view of the example shown in FIG. 2.
Figure 4:
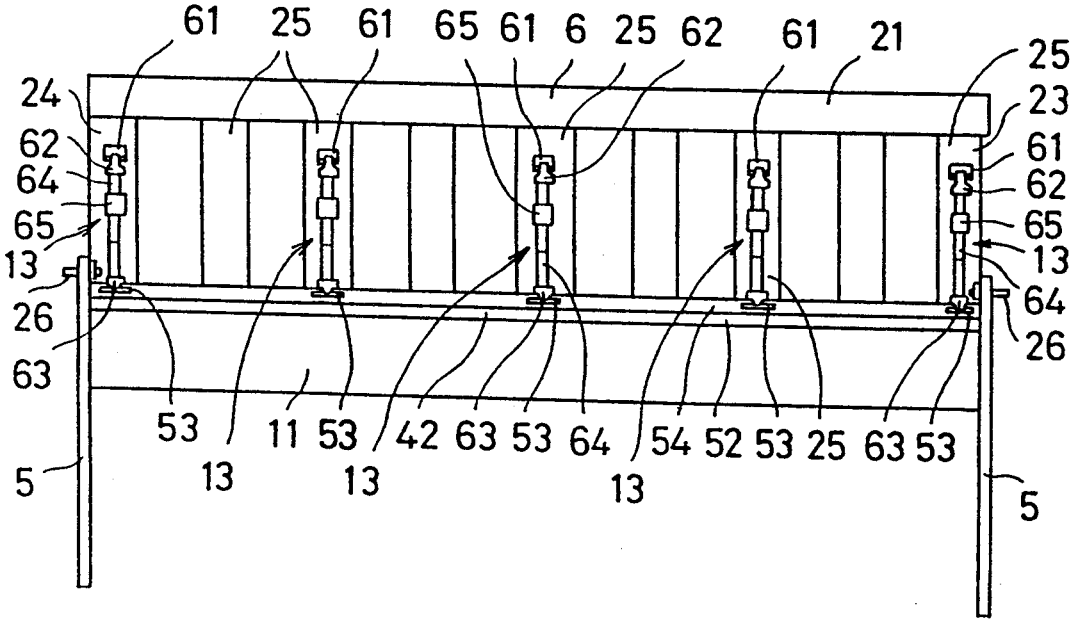
FIG. 4 is a rear view of the embodiment shown in FIG. 1.
Figure 5:
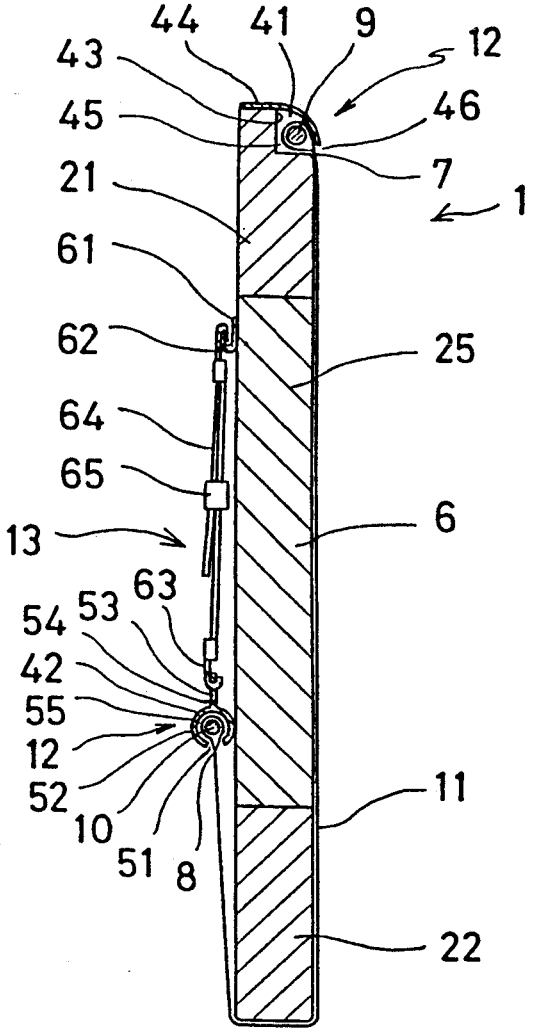
FIG. 5 is a cross-sectional view taken along line V—V shown in FIG. 1.
Figure 7:
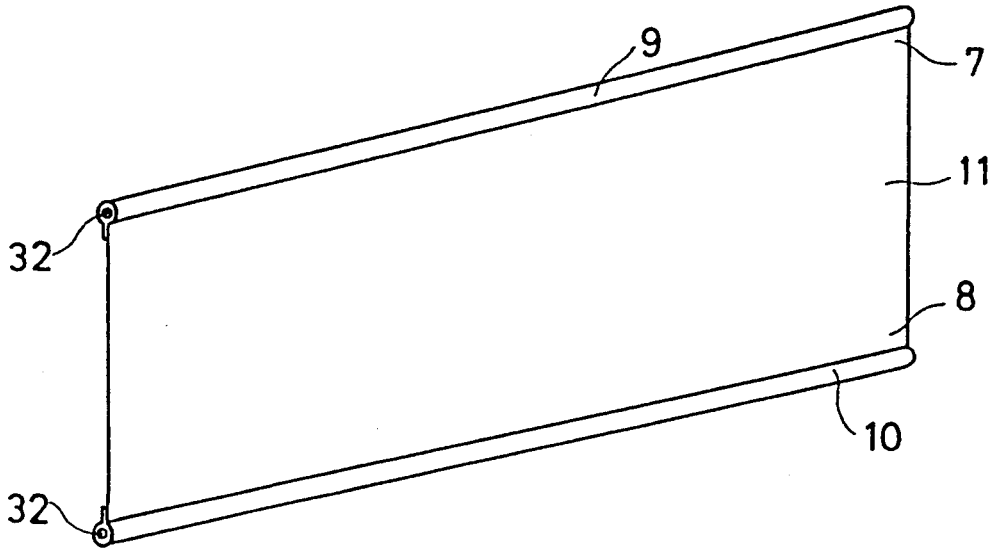
FIG. 7 is an overall perspective view of the sheet shown in FIG. 5.

In FIGS. 1 and 7, one visual panel 1 in this embodiment is allotted to each of two lanes 3 in such a manner as to cover and conceal from a competitor a lifting device portion of an apparatus for automatically aligning and arranging bowling pins 4 at a distal end of the lane 3 in a bowling alley 2. The visual panels 1 are disposed in a series by being supported by columns 5 rotatably in the direction of A. Each visual panel 1 comprises a frame 6; a flexible sheet 11 having swollen portions 9 and 10 at opposite edge portions 7 and 8; sheet stretching means 12 for slidably accommodating the swollen portions 9 and 10 at the opposite edge portions 7 and 8; and tension adjusting means 13 for adjusting the tension applied to the sheet 11.

The frame 6 has upper and lower horizontal members 21 and 22, left and right vertical members 23 and 24, and a plurality of intermediate vertical members 25, which are connected to each other by means of screws or the like. The frame 6 is disposed in such a manner as to be rotatable in the direction of A by means of hinge mechanisms comprised of shafts 26 and bearings (not shown) disposed in the left and right vertical members 23 and 24.

The swollen portion 10 at the edge portion 8 of the sheet 11 is formed such that the edge portion 8 is turned up and sewn together, and a flexible rope 32 is inserted into a loop formed therein. The other swollen portion 9 is also formed in the same way as the swollen portion 10.

The stretching means 12 has a first stretching device 41 for accommodating the swollen portion 9 at one edge portion 7 of the sheet 11 and a second stretching device 42 for accommodating the swollen portion 10 at the other edge portion 8 of the sheet 11. The stretching device 41 has a notch 43 formed in a front apex portion of the horizontal member 21 of the frame 6 and a cover plate 44 covering the notch 43 and secured to the horizontal member 21 by means of screws or the like. Formed in the stretching device 41 is a hole 45 for slidably accommodating the swollen portion 9 at the edge portion 7 of the sheet 11 by being surrounded by the curved cover plate 44 and the notch 43. In addition, the tip of the cover plate 44 is disposed with a slight gap between the same and the horizontal member 21 so as to form a slit 46 through which the edge portion 7 of the sheet 11 which continues to the swollen portion 9 is inserted. Thus the first stretching device 41 secured to the frame 6 has the hole 45 for slidably accommodating the swollen portion 9 at the edge portion 7 of the sheet 11 and the slit 46 through which the edge portion 7 of the sheet 11 which continues to the swollen portion 9 is inserted.

The stretching device 42 which is elongated has a cylindrical portion 52 having a slit 51 and a plate-like portion 54 formed integrally with the cylindrical portion 52 and having a plurality of rectangular through holes 53. In the stretching device 42, the inner space of the cylindrical portion 52 is formed as a hole 55. Hence, the second stretching device 42 disposed movably with respect to the frame 6 has the hole 55 for slidably accommodating the swollen portion 10 at the edge portion 8 of the sheet 11 and the slit 51 through which the edge portion 8 of the sheet 11 which continues to the swollen portion 10 is inserted.

The tension adjusting means 13 for adjusting the tension applied to the sheet 11 has the following: hook retainers 61 which are respectively secured to the vertical members 23 and 24 and the intermediate vertical members 25 by means of screws or the like; hooks 62 which are respectively retained at the hook retainers 61; other hooks 63 retained at the plate-like portion 54 through the through holes 53, respectively; lashing belts 64 each stretched between the hooks 62 and 63; and buckles 65 each attached to the lashing belt 64 so as to adjust the distance between the hooks 62 and 63. In the above-described manner, the tension adjusting means 13 is disposed between the stretching device 42 and the frame 6.

Figure 6:
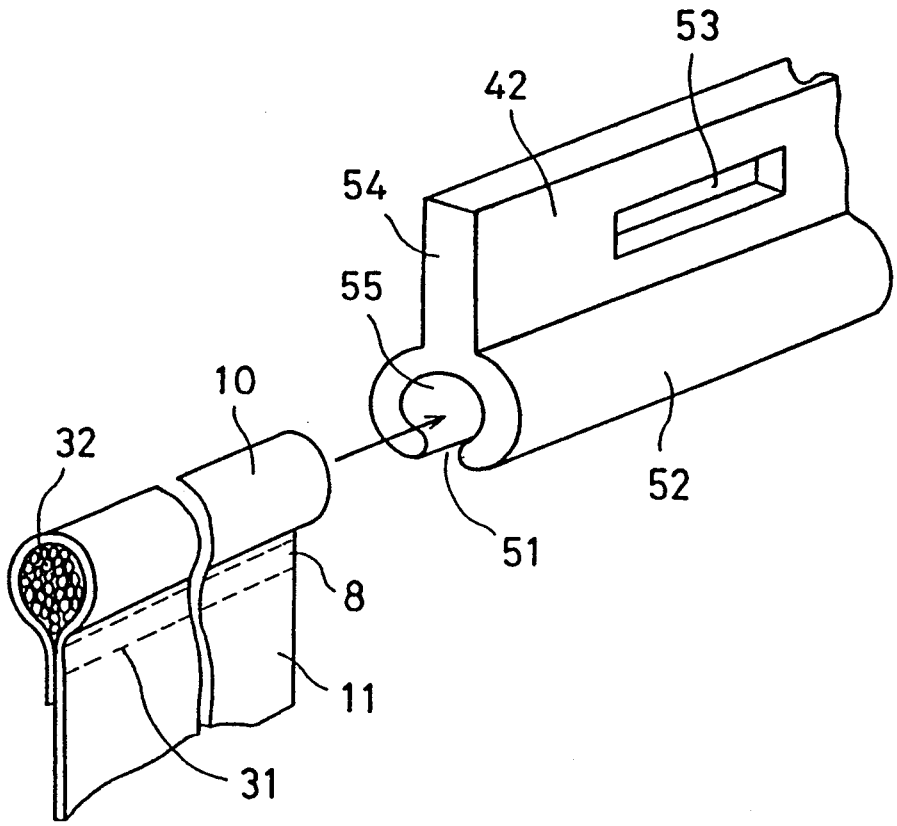
FIG. 6 is a detailed perspective view of a second stretching device and the like shown in FIG. 5.

The visual panel 1 formed as described above is disposed at the distal end of each lane 3 in the bowling alley 2, as shown in FIG. 1. By means of, for instance, a photograph printed on the front of the sheet 11 of the visual panel 1, the atmosphere of the interior of the bowling alley 2 is made a visually pleasing one. When it is desirous to change the atmosphere of the interior of the bowling alley 2, the following procedure is taken: The visual panel 1 is rotated in the direction of A to cause the rear surface of the visual panel 1 to face the operator's side; the tension applied to the sheet 11 by means of the lashing belts 64 is alleviated; the swollen portions 9 and 10 are pulled out of the respective holes 45 and 55; the sheet 11 is removed from the frame 6; the swollen portion 10 of a new sheet 11 is inserted into the hole 55 in the horizontal direction, as shown in FIG. 6; and the other swollen portion 9 is similarly inserted into the hole 45 in the horizontal direction, thereby fitting the sheet 11 on the frame 6. Subsequently, one ends of the lashing belts 64 are pulled to impart an appropriate tensile force to the sheet 11, thereby stretching the sheet 11 tautly.

The visual panels 1 make it possible to change the atmosphere of the interior of the bowling alley 2 simply by changing the sheets 11. In addition, since the sheets 11 rendered unnecessary after being replaced and the new sheets 11 are flexible, they can be transported by being folded up or rolled up. Hence, the transportation of these sheets is not troublesome, and a multiplicity of sheets can be transported at one time, with the result that the operating efficiency is improved remarkably.

Figure 8:
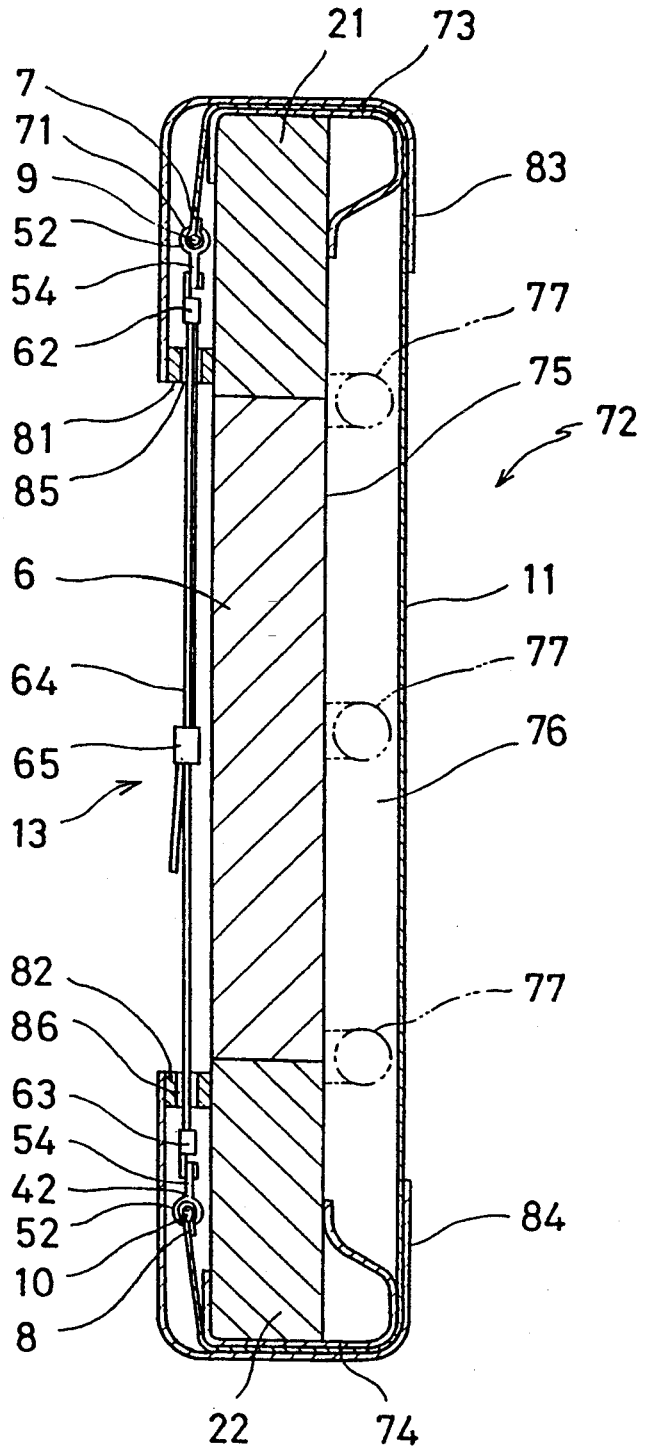
FIG. 8 is a cross-sectional view of another preferred embodiment of the present invention, and corresponds to FIG. 5.

In the above-described embodiment, the visual panel 1 is formed by the first stretching device 41 secured to the frame 6 and the second stretching device 42 disposed movably with respect to the frame 6. Instead of this arrangement, an arrangement may be alternatively provided as shown in FIG. 8. Namely, a first stretching device 71 for accommodating the swollen portion 9 at one edge portion 7 of the sheet 11 is formed in the same way as the stretching device 42, the hooks 62 are retained at the plate-like portion 54 of the stretching device 71 via the through holes 53 formed in the plate-like portion 54. Thus, the first and second stretching devices 71 and 42 are disposed movably with respect to the frame 6, and the tension adjusting means 13 is disposed between the first stretching device 71 and the second stretching device 42, thereby forming a visual panel 72.

In this visual panel 72, the sheet 11 is stretched while being guided by space-forming members 73 and 74 attached to the upper and lower horizontal members 21 and 22 of the frame 6 by means of screws or the like, and a space 76 is formed between a front surface 75 of the frame 6 and the sheet 11 opposing the front surface 75 by means of the space-forming members 73 and 74. In this space 76, illuminating devices 77 such as fluorescent lamps may be provided, as required, and the sheet 11 may be illuminated from the rear by the illuminating devices 77, thereby obtaining a more favorable visual effect. In the visual panel 72 of this embodiment, covers 83 and 84 are respectively fitted at upper and lower ends of the frame 6 via mounting plates 81 and 82 secured to the frame 6 by means of screws or the like. A plurality of through holes 85 and 86 through which the lashing belts 64 can be inserted are formed in the mounting plates 81 and 82 in correspondence with the through holes 53.

Figure 9:
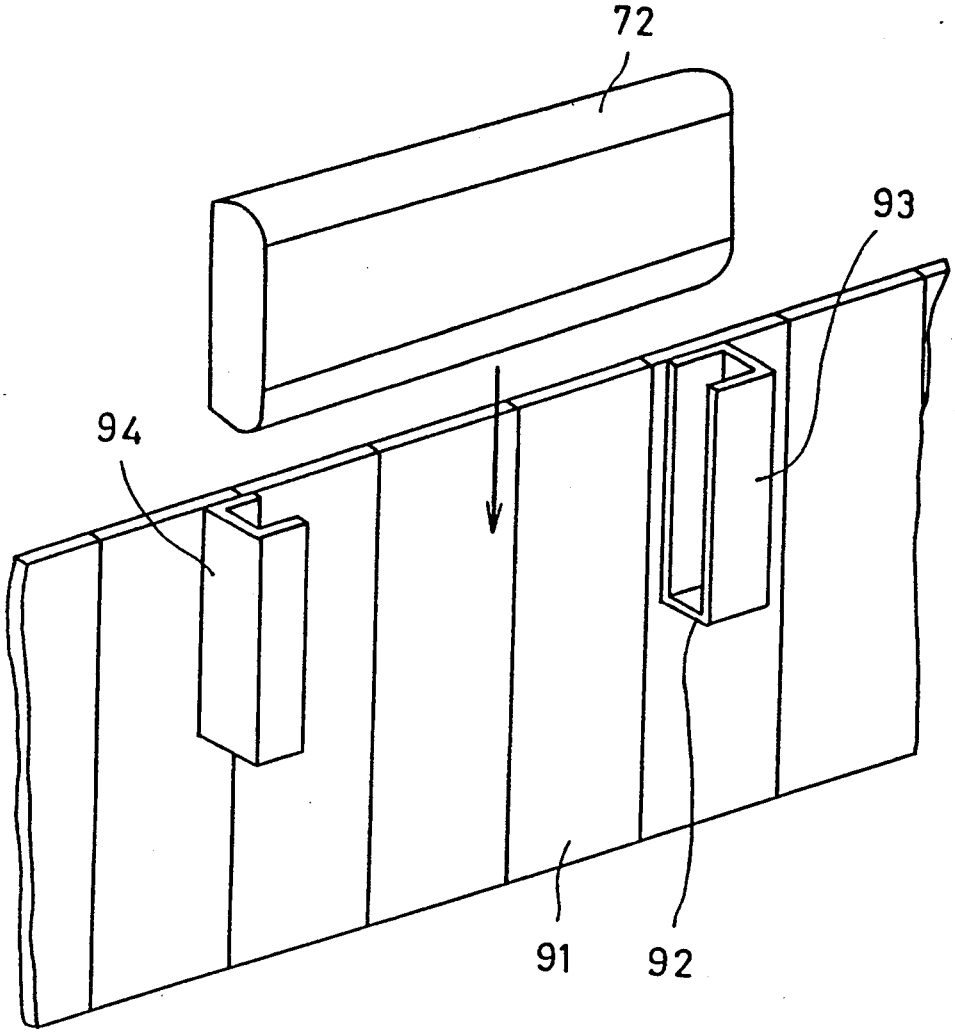
FIG. 9 is a perspective view of another example in which the embodiment shown in FIG. 8 is used.

Although, in the above embodiments, a description has been given of the use of the visual panels 1 and 72 in the bowling alley 2, the visual panel of the present invention is not limited to such use. For instance, as shown in FIG. 9, an arrangement may be provided such that U-shaped support members 93 and 94 each having a bottom plate 92 are fixed to an enclosing wall 91 provided in such a manner as to surround a construction site, and the visual panel 72 is inserted thereinto to give a display for the construction site. In this case, if the illumination device 77 is mounted in the visual panel 72, a display can be provided favorably even at night. To change the contents of the display, it suffices if the sheet 11 is replaced as described above.

Figure 10:
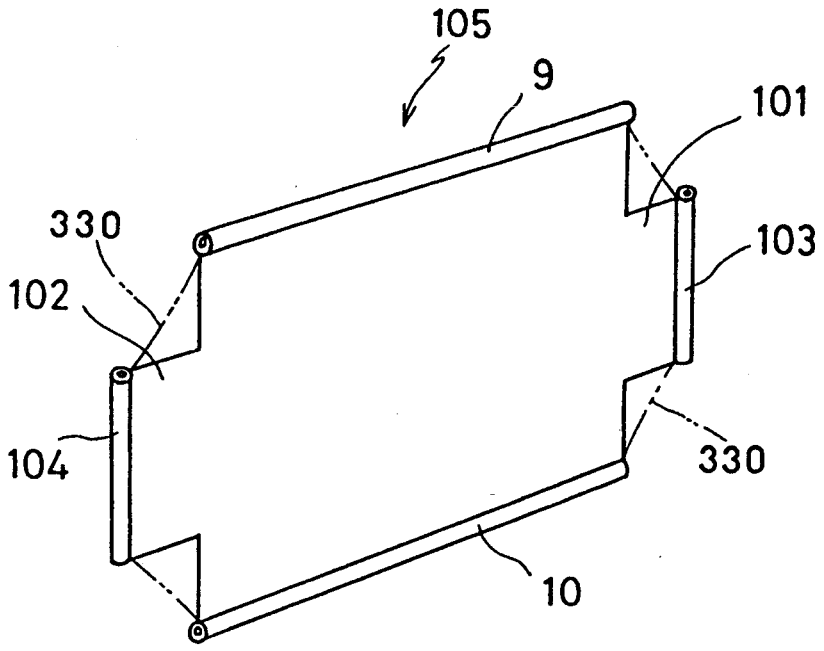
FIG. 10 is a perspective view of another example of the sheet used in the present invention.
Figure 11:
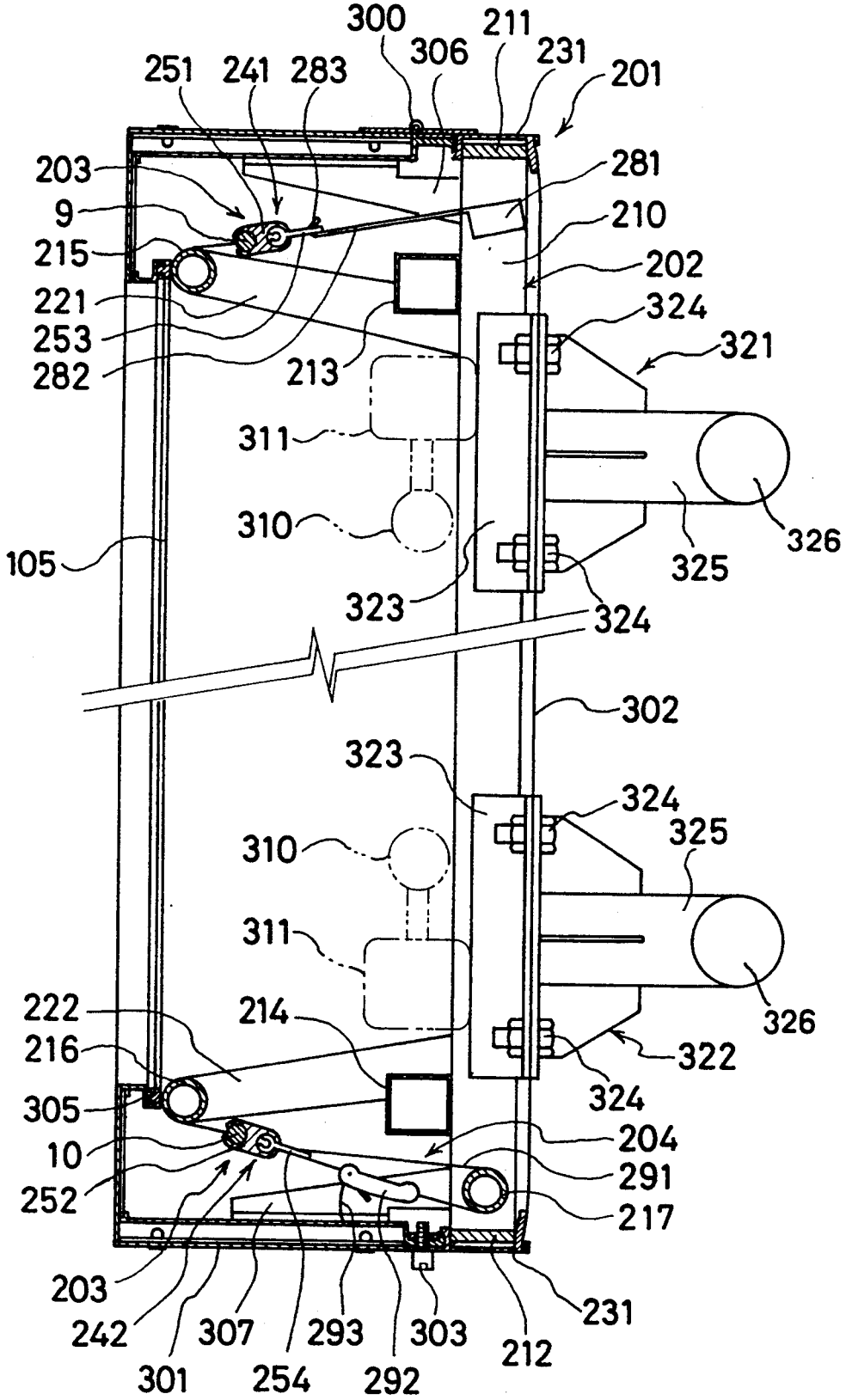
FIG. 11 is a cross-sectional view of still another preferred embodiment of the present invention.
Figure 12:
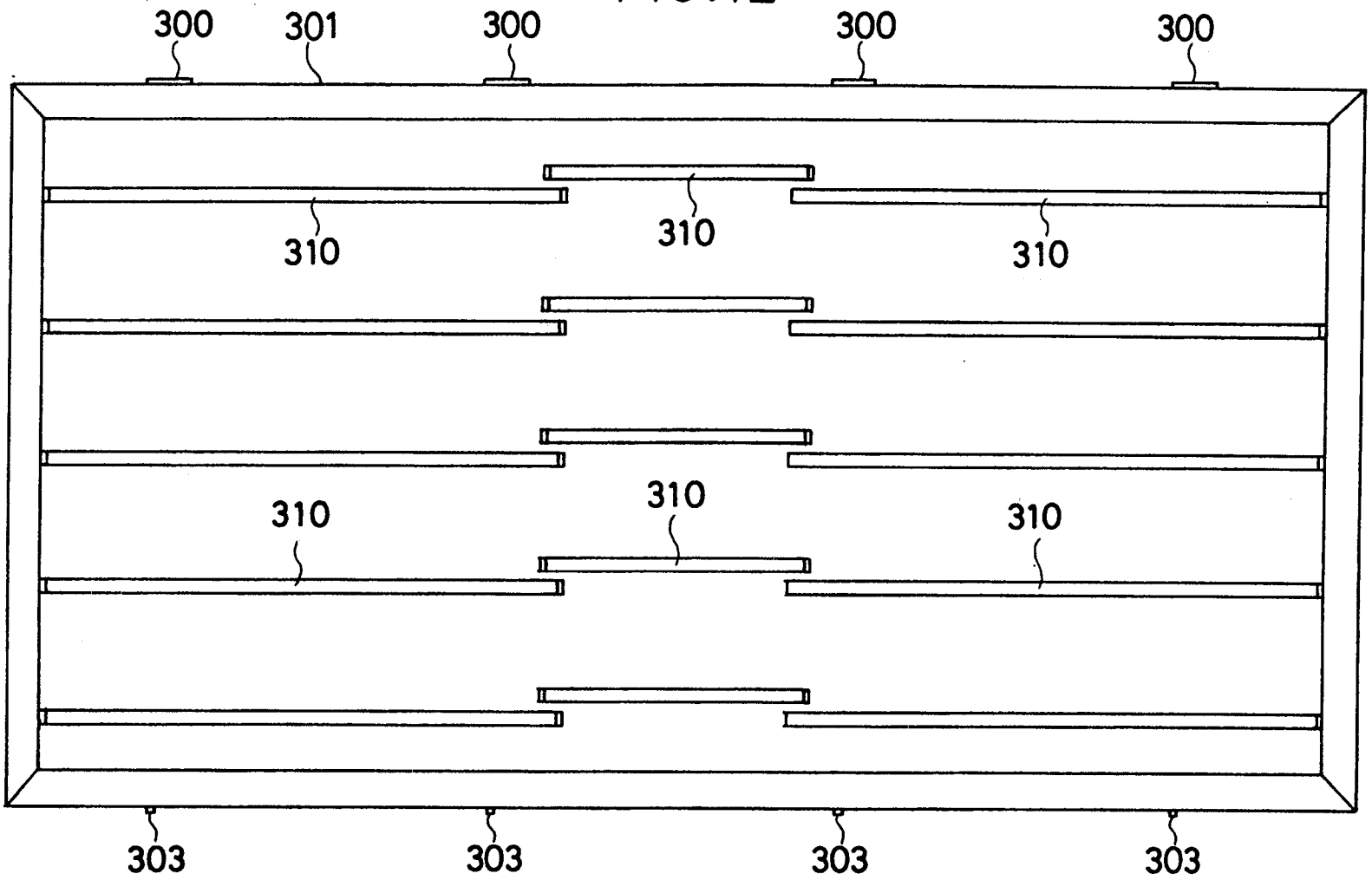
FIG. 12 is a front elevational view in which the sheet and the like are removed in the embodiment shown in FIG. 11.
Figure 13:
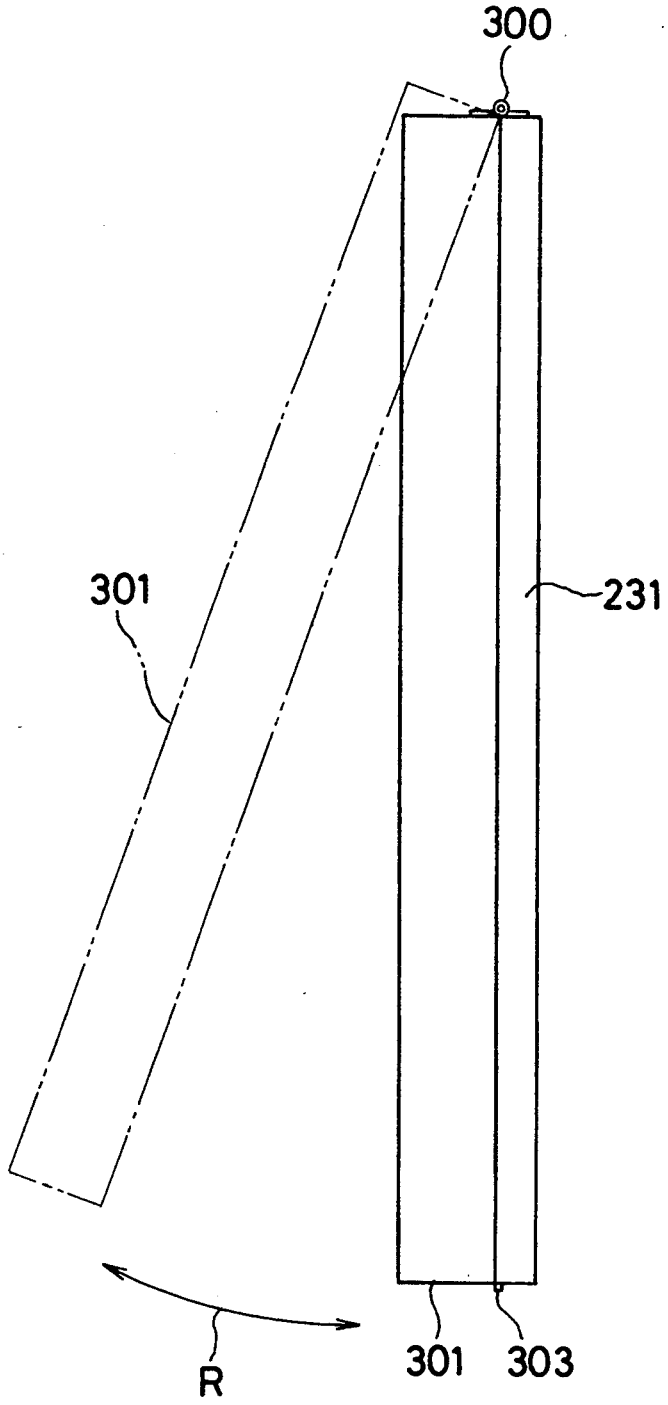
FIG. 13 is a side elevational view of the embodiment shown in FIG. 11.

As the sheet, although in the above examples a description has been given of a rectangular sheet 11 having the swollen portions 9 and 10 at the upper edge portion 7 and the lower edge portion 8, as shown in FIG. 7, it is possible to use, instead, a sheet 105 in which, in addition to the swollen portions 9 and 10, additional swollen portions 103 and 104 are respectively formed in horizontally projecting portions 101 and 102, as shown in FIG. 10. When the sheet 105 is used, the frame 6 is enveloped by the sheet 105, and stretching devices and tension adjusting means are also used for the swollen portions 103 and 104 in the same way as described above. If this arrangement is adopted, a tensile force can be imparted to the sheet 105 in the horizontal direction as well, so that the sheet can be stretched more tightly in some cases.

Referring now to FIGS. 11 to 14, a description will be given of still another embodiment of the present invention.

A visual panel 201 of this embodiment comprises the flexible sheet 105 having the swollen portions 9 and 10, and 103 and 104 at the two sets of opposing edge portions; sheet stretching means 203 for slidably receiving the swollen portions 9 and 10 at the opposite edge portions of the sheet 105 and for stretching the sheet 105 over a frame 202; and tension adjusting means 204 for adjusting the tension applied to the sheet 105.

The frame 202 of this embodiment includes a pair of vertical members 210 (one is not shown) disposed in parallel; horizontal members 211 and 212, and 213 and 214 whose ends are respectively secured to the pair of vertical members 210 by welding or other similar means and which are disposed in parallel with each other by bridging the pair of vertical members 210; and cylindrical members 215, 216 and 217 disposed in parallel with each other in the same way as these horizontal members 211, 212, 213 and 214. Intermediate vertical members are provided on the frame 202 in parallel with the vertical members 210, as required. Secured to respective one ends of the cylindrical members 215 and 216 are other ends of brackets 221 and 222 whose one ends are secured to the vertical members 210 by means of welding or the like. Thus, respective one ends of the cylindrical members 215 and 216 are supported by the vertical members 210 via the brackets 221 and 222. The other ends (not shown) of the cylindrical members 215 and 216 are also supported by brackets similar to the brackets 221 and 222. In addition, brackets similar to the brackets 221 and 222 may be provided between intermediate portions of the cylindrical members 215 and 216 on the one hand, and the horizontal members 213 and 214 or the intermediate vertical members on the other, so that the intermediate portions of the cylindrical members 215 and 216 will not be deflected. The cylindrical member 217 bridges and secures the pair of vertical members 210 in the same way as the horizontal members 211 and 212.

It should be noted that a cover 231 is secured to the pair of vertical members 210 and the horizontal members 211 and 212 by means of fitting, screws or the like in such a manner as to cover the outer sides of these members.

In the stretching means 203 of this embodiment, a first stretching device 241 for accommodating the swollen portion 9 at one edge portion of the sheet 105 and a second stretching device 242 for accommodating the swollen portion 10 at the other edge portion of the sheet 105 are each provided with couplers 251 and 252 and a plurality of adjusters 253 and 254. The coupler 251 is formed as being identical to the coupler 252, and the adjuster 253 is formed as being identical to the adjuster 254. Accordingly, a description will be given hereafter of only the coupler 251 and the adjuster 253.

Figure 14:
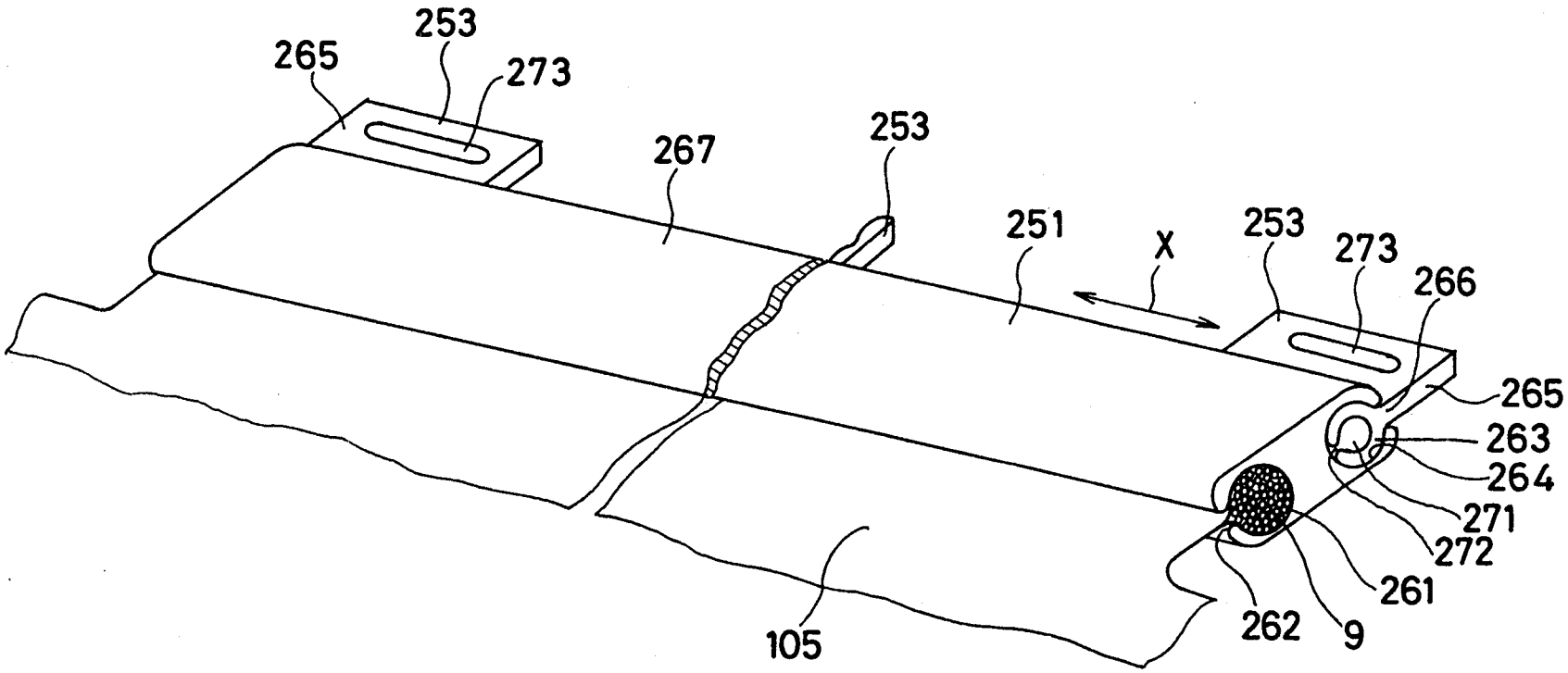
FIG. 14 is a perspective view of a coupler used in the embodiment shown in FIG. 11.

As shown in FIG. 14, the elongated coupler 251 has a hole 261 for accommodating the swollen portion 9 at one edge portion of the sheet 105; a slit 262 through which the edge portion of the sheet 105 continuing to the swollen portion 9 is inserted; a hole 264 for slidably accommodating a swollen portion 263 of the adjuster 253; and a slit 266 through which a plate-like portion 265 of the adjuster 253 continuing to the swollen portion 263 is inserted. The holes 261 and 264 and the slits 262 and 266 are provided over the entire length of a body 267 of the coupler 251. Each of the adjusters 253 is provided with the swollen portion 263 and the plate-like portion 265 formed integrally with the swollen portion 263, as described above. A hollow portion 271 and a slit 272 communicating with the hollow portion 271 are formed in the swollen portion 263, and an elongated hole 273 is formed in the plate-like portion 265.

The insertion of the swollen portions 9 and 263 into the holes 261 and 264 is effected from the horizontal direction in the same way as the example described by using FIG. 6. As a result of the fact that the swollen portion 263 is slidably accommodated in the hole 264, the position of each of the adjusters 253 is adjustable in the direction of X with respect to the coupler 251, i.e., with respect to the longitudinal direction of the coupler 251. A hook portion 283 of a fixed coupler 282 having one end 281 secured to the vertical member 210 by means of welding or the like is retained at the elongated hole 273 in the adjuster 253. The stretching device 241 is thus coupled to the frame 202. It should be noted that, in the fixed coupler 282, a portion between its one end 281 and the hook portion 283 may be formed by a coil spring. A belt 291 of the tension adjusting means 204 is inserted through an elongated hole (not shown) in the plate-like portion of the adjuster 254 which is formed in the same way as the adjuster 253.

The tension adjusting means 204 has the belt 291 and a buckle 292 connected to the belt 291. The belt 291 is inserted through the elongated hole (not shown) in the plate-like portion of the adjuster 254, as described above, and is trained to the cylindrical member 217. As a result, if one end 293 of the belt inserted through the buckle 292 is pulled, the distance between the adjuster 254 and the cylindrical member 217 can be shortened, thereby making it possible to stretch the sheet 105 tautly.

It should be noted that, in the visual panel 201, arrangements similar to those for the stretching devices 242 and the tension adjusting means 204 are provided for the swollen portions 103 and 104 of the horizontally projecting portions 101 and 102, so that the sheet 105 is stretched tautly in the horizontal direction as well.

The visual panel 201 of this embodiment is further provided with an edge cover 301 attached to the cover 231 rotatably in the direction of R via hinges 300 and a rear plate 302 having its peripheral edges fitted to the cover 231. The edge cover 301 can be secured to the cover 231 by means of screws 303, so that if the screws 303 are removed, the edge cover 301 is rotatable about the hinge 300 in the direction of R. A pad 305 is fitted to inner peripheral edges of the edge cover 301. The pad 305 clamps the sheet 105 in cooperation with the cylindrical members 215 and 216 and stretches slight creases and the like occurring in the sheet 105 to prevent them from occurring. Holding members 306 and 307 are attached to the vertical members 210 by means of welding or the like so as to hold the edge cover 301 securely when the edge cover 301 is closed. In this embodiment as well, a multiplicity of fluorescent lamps 310, which are illuminating means, may be attached to the frame 202 via supports 311. In addition, in order to mount the visual panel 201 onto a wall or the like, mounting devices 321 and 322 may be attached to the vertical members 210 and the like by means of welding or the like. The mounting devices 321 and 322 are each constituted by a member 323 welded to the vertical member 210 or the like and a bracket 325 secured to the member 323 by means of bolts 324.

The visual panel 201 formed as described above is mounted onto, for instance, an enclosure frame or the like at a construction site via horizontal pipes or horizontal bars 326 welded onto the brackets 325. With the visual panel 201 as well, if the edge cover 301 is rotated in the direction of R after removing the screws 303, and if the belts 291 are then loosened to slacken the sheet 105, and the swollen portions 9 and 10 are drawn out from the couplers 251 and 252, the replacement of the sheet 105 can be performed easily.

Although in the above-described embodiments the sheet is provided only on one side of the frame, the sheet may be provided on both sides of the frame, in which case the illuminating devices may also be provided between the frame and the respective sheets. Furthermore, the visual panels may be arranged in the shape of a prism, e.g., a quadrangular prism, and castors may be provided at the lower ends of the visual panels so as to render the visual panels movable.

Although, in the sheet 105 shown in FIG. 10, the horizontally projecting portions 101 and 102 project orthogonally with angular portions, the present invention is not restricted to such a sheet 105. For instance, this horizontally projecting portion may be formed in such a manner as to project with smooth arcuate edges 330.

I claim:

1. A visual panel comprising:

a frame;

a flexible sheet having enlarged portions at opposing edge portions thereof, respectively;

sheet stretching means for stretching said sheet over said frame;

tension adjusting means disposed between said frame and said sheet stretching means for adjusting a tension applied to said sheet;

said stretching means comprising a first stretching device for accommodating said enlarged portion at one edge portion of said sheet and a second stretching device for connecting said enlarged portion at the other edge portion of said sheet with the frame, said first stretching device including a coupler having a hole for slidably accommodating said enlarged portion at said one edge portion of said sheet and a slit through which said edge portion of said sheet continuing to said enlarged portion is passed, said tension adjusting means being connected at one end thereof to a portion of the coupler which opposes said slit of the coupler.

2. A visual panel according to claim 1, further comprising an illuminating device disposed between said sheet and said frame.

3. A visual panel comprising:

a frame;

a flexible sheet having enlarged portions at opposing edge portions thereof, respectively;

sheet stretching means for slidably accommodating said enlarged portions at said opposing edge portions of said sheet and for stretching said sheet over said frame;

tension adjusting means for adjusting a tension applied to said sheet;

said stretching means comprising a first stretching device for accommodating said enlarged portion at one edge portion of said sheet and a second stretching device for accommodating said enlarged portion at the other edge portion of said sheet, said first stretching device having first coupler, a plurality of first adjusters, and hooking means, said first coupler having a first hole for slidably accommodating said enlarged portion at said one edge portion of said sheet and a first slit through which said one edge portion of said sheet continuing to said enlarged portion is passed, and said first coupler further having a second hole and second slit, said first adjusters each having an enlarged portion which is slidably accommodated by said second hole of the first coupler, and a plate-like portion formed integrally with the enlarged portion of the first adjuster, and passing through said second slit of the first coupler, said plate-like portion of each said first adjuster having a through hole, by means of which said hooking means hooks the plate-like portion of the first adjuster at one end thereof, said hooking means being secured at another end thereof to said frame, said second stretching device having a second coupler and a plurality of second adjusters, said second coupler having a third hole for slidably accommodating said enlarged portion at said other opposed edge portion of said sheet and a third slit through which said other opposed edge portion of said sheet continuing to said enlarged portion is passed, and said second coupler further having a fourth hole and a fourth slit, said second adjusters each having an enlarged portion which is slidably accommodated by said fourth hole of the second coupler, and a plate-like portion formed integrally with the enlarged portion of the second adjuster, and passing through said fourth slit of the second coupler, said plate-like portion of each said second adjuster having a through hole, by means of which said tension adjusting means is connected to the plate-like portion of said second adjuster at one end thereof, whereby said tension adjusting means disposed between second stretching device and said frame adjusts the tension applied to said sheet.

4. A visual panel according to claim 3, further comprising an illuminating device disposed between said sheet and said frame.

5. A visual panel according to claim 3, wherein said tension adjusting means has a second hooking means for hooking said plate-like portion of the second adjuster by means of said through hole of the second adjuster to connect the second adjuster and said one end of the tension adjusting means to each other.

* * * * *

UNITED STATES PATENT AND TRADEMARK OFFICE

CERTIFICATE OF CORRECTION

PATENT NO. : 5,398,436
DATED : March 21, 1995
INVENTOR(S) : TERUO SUZUKI

It is certified that error appears in the above-identified patent and that said letters patent is hereby corrected as shown below:

On title page, item [87], change the PCT Publication date to --April 29, 1993--.

Signed and Sealed this

Thirteenth Day of August, 1996

*Attest:*

*Attesting Officer*

BRUCE LEHMAN

*Commissioner of Patents and Trademarks*